United States Patent [19]

Shimamura

[11] Patent Number: 4,976,422

[45] Date of Patent: Dec. 11, 1990

[54] ARTIFICIAL SKI SLOPE

[75] Inventor: Eiji Shimamura, Tokyo, Japan

[73] Assignee: Kajima Corporation, Tokyo, Japan

[21] Appl. No.: 447,645

[22] Filed: Dec. 8, 1989

[30] Foreign Application Priority Data

Dec. 9, 1988 [JP] Japan ..... 63-311409

[51] Int. Cl.[5] ..... E04H 3/14

[52] U.S. Cl. ..... 272/56.555

[58] Field of Search ..... 272/56.555, 56.5 R; 52/148

[56] References Cited

U.S. PATENT DOCUMENTS 3,601,944 8/1971 Shepherd ..... 52/148

FOREIGN PATENT DOCUMENTS 2052441 5/1972 Fed. Rep. of Germany ..... 272/56.555

1303040 7/1962 France ..... 272/56.555

628938 10/1978 U.S.S.R. ..... 272/56.555

*Primary Examiner*—Richard E. Chilcot, Jr.

*Attorney, Agent, or Firm*—James H. Tilberry

[57] ABSTRACT

An artificial ski slope which is adapted to be erected on level ground. A tower is erected at one end of the slope, anchors are embedded at the opposite end of the slope, and suspension cables are strung between the top of the tower and the anchors. A ski slope platform is hung from the suspension cables. Utilizing this basic concept, several ski slope platforms may be radially arrayed about a single tower.

26 Claims, 4 Drawing Sheets

ARTIFICIAL SKI SLOPE

BACKGROUND OF THE INVENTION

1. Field of the Invention

This invention relates to artificial ski slopes as indoor facilities.

2. Description of the Prior Art

Prior indoor artificial ski slopes generally attempted to utilize naturally inclined terrain which provided artificially constructed slopes covered with artificial snow, protected with a roof or the like. More recently, however, there has developed a high demand for artificial ski slopes to be constructed in areas without high snowfall. When artificial ski slopes are constructed on flat ground, it is difficult to obtain sufficient slope elevation, ski run width, or length of run. The reasons for these difficulties primarily reside in construction problems encountered in attempting to erect structures of sufficient height and sturdiness which at the same time provide a challenging run. As a result, conventional indoor artificial ski runs are deficient in practical value as ski facilities for recreation.

Heretofore, the assignee of the present application had proposed an artificial ski complex having a helical ski run about a central tower. This concept has been granted U.S. Pat. No. 4,790,531. The present invention utilizes space linearly rather than vertically.

SUMMARY OF THE INVENTION

The present invention is based on the principle of a suspension bridge. A main tower is erected to the required height for a good ski run, while anchor means are spaced from the tower substantially the distance of the desired run. Catenary cables are then stretched between the top of the main tower and the anchor means, and a suspension floor constituting a ski running area is suspended from and supported by the catenary members after the fashion of a suspension bridge. With this concept, there is no serious limitation to either height or length of run, and the slope can be erected on flat ground.

Suspension members of predetermined lengths depend from the catenary cables at proper intervals to support the suspension floor, which is built between the main tower and the ground level at the anchor means.

The surface of the suspension floor is covered with artificial snow and is enclosed with side walls and a roof. The inventive structure provides an artificial ski slope having an elevation and ski run distance comparable to a natural ski run.

DETAILED DESCRIPTION OF THE INVENTION

Figure 1:
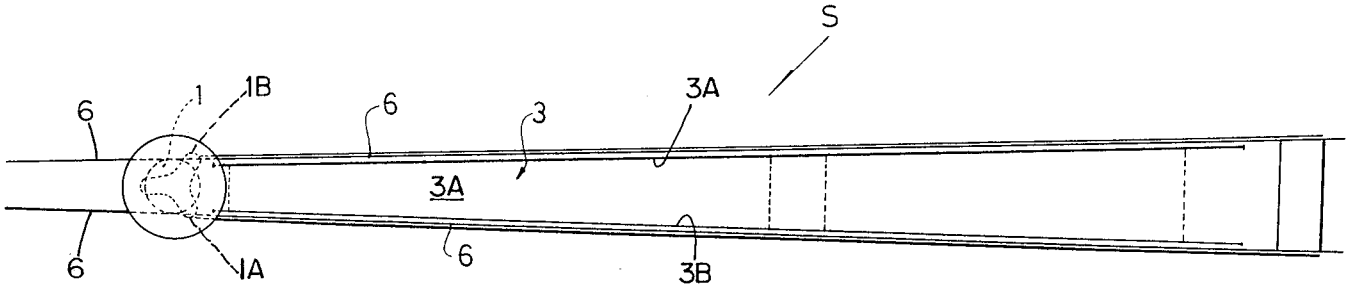
FIG. 1 is a plan view of a preferred embodiment of the invention.
Figure 2:
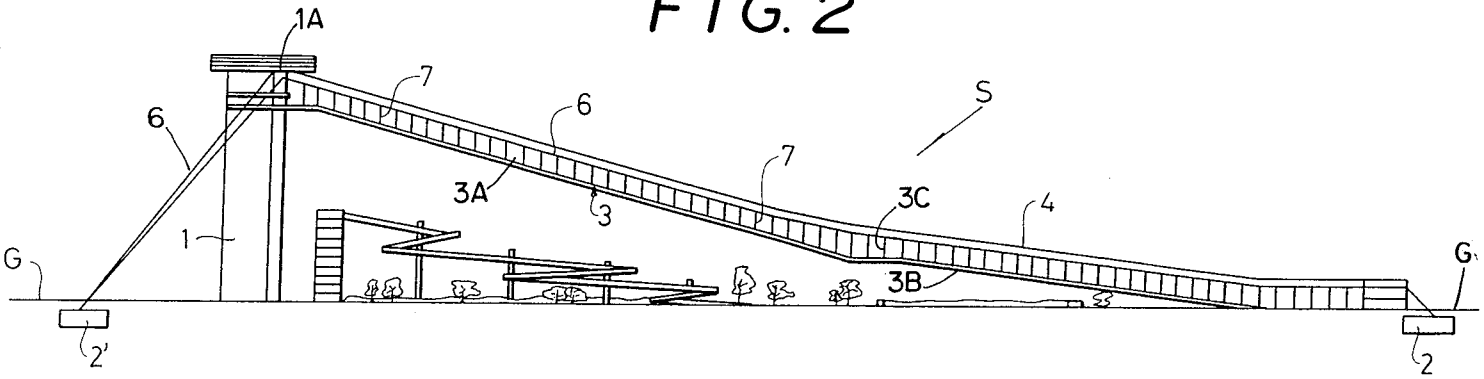
FIG. 2 is an elevational view of a preferred embodiment of the invention.
Figure 3:
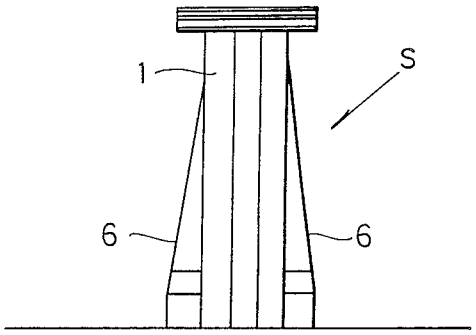
FIG. 3 is a left-side elevational view of the invention shown in FIG. 2.
Figure 4:
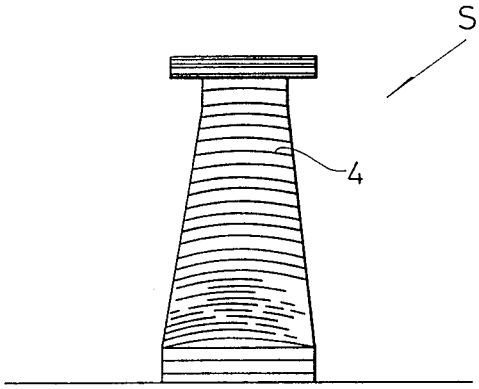
FIG. 4 is a right-side elevational view of the invention shown in FIG. 2.
Figure 5:
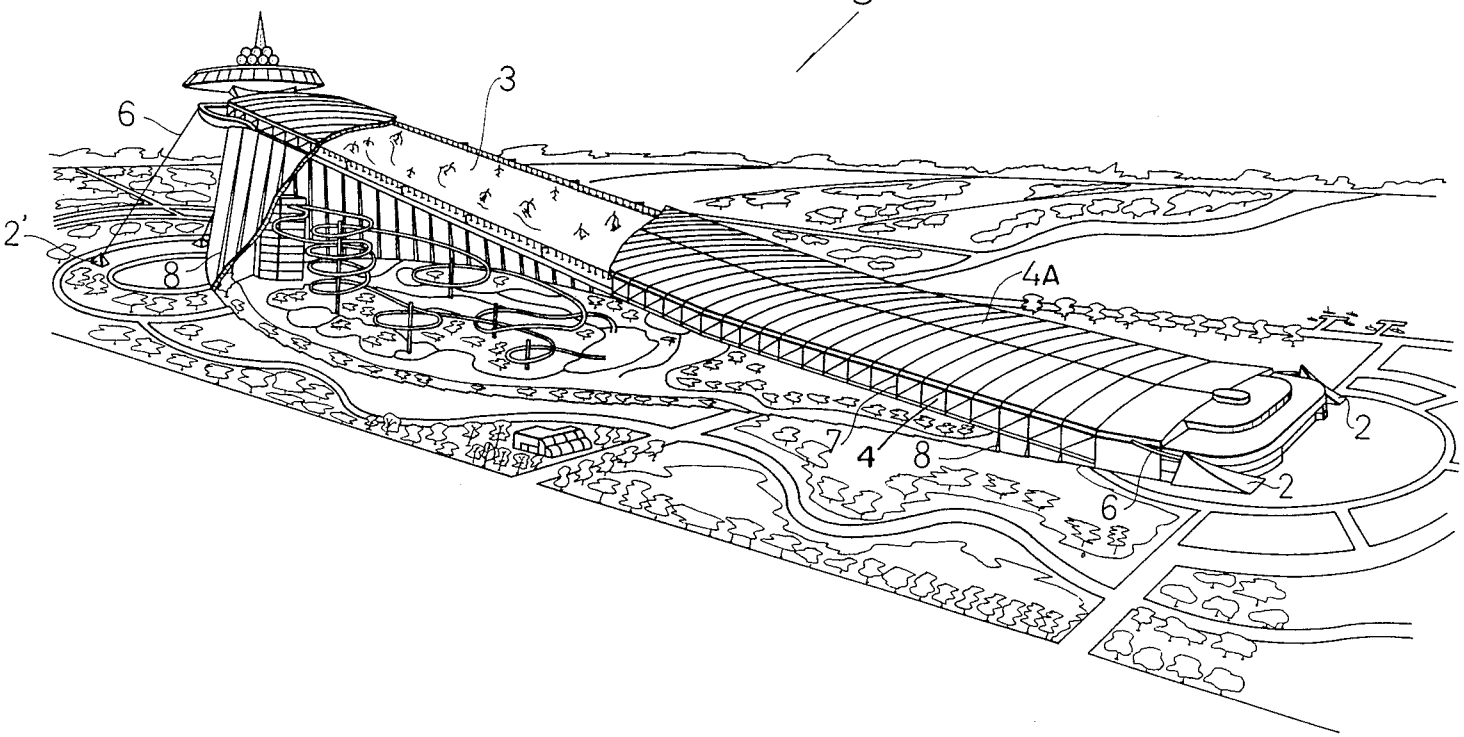
FIG. 5 is a panoramic view of the invention shown in FIG. 2.

As best shown in FIGS. 1, 2, and 5, an artificial ski slope S is so constructed that a suspension floor 3, constituting a ski running area, is provided between a main tower 1 vertically erected on the ground G and an anchor 2 fixed in position in the ground G, spaced apart from the main tower 1. As shown in FIG. 5, side walls 4 and a roof 4A enclose the suspension floor 3 to make the ski slope an indoor facility.

Figure 6:
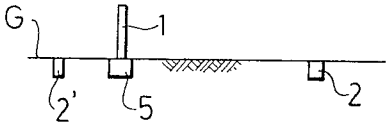
FIG. 6 is a schematic elevation of a preferred embodiment of the invention showing the tower and anchors in place.
Figure 7:
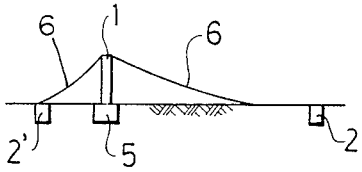
FIG. 7 is a schematic elevation of a preferred embodiment of the invention showing the suspension catenary member in place.
Figure 8:
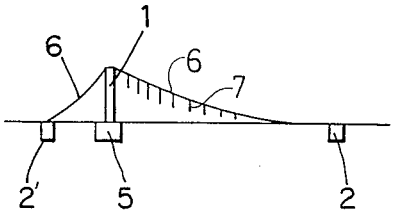
FIG. 8 is a schematic elevation of a preferred embodiment of the invention showing the ski slope suspension cables depending from the suspension catenary member.
Figure 9:
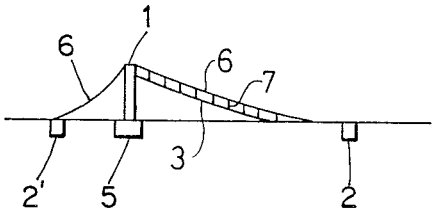
FIG. 9 is a schematic elevation of a preferred embodiment of the invention showing the suspended ski slope in place.

As shown in FIG. 6, similar to construction of a suspension bridge, the main tower 1 is erected on a opposite sides of tower 1. The anchors 2, 2' are installed in pairs on opposite sides of the slope and tower, respectively. Catenary cables 6 are secured between the tower and respective anchors to support the suspension floor 3 by means of short lengths of cables 7 vertically depending from catenary cables 6.

The height of the main tower 1 is about 30 meters to 100 meters, and the distance between the main tower 1 and the anchor 2 on the side of the suspension floor 3 is several hundred meters. As best shown in FIGS. 1, 2, and 5, the catenary cable members 6 are stretched from the anchors 2 on the side of the suspension floor side of the tower 1 to the anchors 2' on the opposite side of the tower so as to bestride the tops 1A and 1B of the tower, and also to parallel the opposite sides 3A and 3B of the suspension floor 3, FIG. 1. The catenary cable members 6 are tensioned on each side of the tower 1 to provide zero turning moment at the tower.

As best shown in FIG. 2, the inclination angles of the suspension floor 3 are determined by selecting the lengths of the suspension members 7. Thus, as best shown in FIG. 2, slope portion 3A is steeper than slope portion 3B, and the two slopes are joined by a level transition portion 3C.

As shown in FIG. 5, guy wires 8 are stretched from the opposite sides of the suspension floor 3 to the ground G to stabilize the suspension floor 3 against transverse sway caused by wind or the like.

In the event that the site of the ski slope is in a congested metropolitan area with buildings, streets, railway tracks, or other obstructions, even including rivers and other waterways, only a minimal amount of land need be acquired to provide the base for the tower 1, the land for the anchors 2 and 2', and the air rights therebetween. In view of the great height of the tower and the elimination of intermediate support stanchions, the suspension floor 3 will clear most land-based, or water, obstacles. Thus, it is now possible with this invention to erect ski slopes in areas where heretofore it would have been unfeasible, if not impossible. By suspending the ski slope over existing structures, these structures may remain in place, undisturbed.

Figure 10:
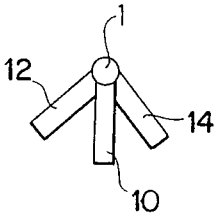
FIG. 10 is a schematic plan view of another preferred embodiment of the invention wherein three ski slopes are secured to the tower.

A modified embodiment of the invention disclosed in FIGS. 1–9 is shown in FIG. 10. Therein is shown a tower 1, an upper ski slope suspension floor 10, and a pair of lower suspension floors 12 and 14. The principle of construction is the same as heretofore described, but three slopes are available to match the abilities of the three basic groups of skiers, novice, intermediate, and skilled.

Figure 11:
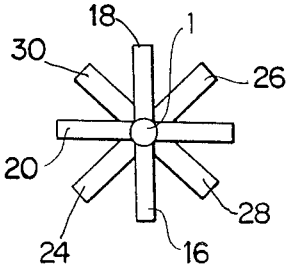
FIG. 11 is a schematic plan view of yet another preferred embodiment of the invention wherein eight ski slopes are secured to the tower.

Another modified embodiment of the invention disclosed in FIGS. 1–9 is shown in FIG. 11. Therein are shown diametrically opposed slopes 16–18, 20–22, 4–26, and 28–30. So arrayed, the slopes are self-balancing with respect to stresses imposed on the tower. Thus, anchors such as 2' shown with the first discussed embodiment can be eliminated. With eight slopes, a wide variety of skiing challenges can be made available, or slopes of equal challenge may be provided to accommodate a maximum number of skiers.

It may occur to those skilled in the art, upon reading the specification in conjunction with a study of the drawings and claims, that certain modifications may be made in the apparatus without departing from the inventive concept, which is intended to be limited only by the scope of the appended claims.

What is claimed is:

1. An artificial ski slope comprising: a tower; first anchor means positioned on one side and away from said tower substantially the length of a first ski slope; catenary suspension means secured at one end to the top of said tower and at the other end to said first anchor means; a ski slope platform; and means to suspend said ski slop platform from said catenary suspension means.

2. The artificial ski slope of claim 1, including a plurality of ski slope platform suspension cables secured to and spaced along said catenary suspension means to depend therefrom; said ski slope platform suspension cables being of predetermined variable lengths to define the contour of said ski slope platform; and means to secure said ski slope platform to the dependent ends of said variable length suspension cables.

3. The artificial ski slope of claim 1, including second anchor means positioned on the opposite side of said tower; and means to secure said tower to said second anchor means.

4. The artificial ski slope of claim 3, wherein said ski slope subjects said tower to a first turning moment and said means to secure said tower to said second anchor means subjects said tower to a second turning moment equal and opposite to said first turning moment.

5. The artificial ski slope of claim 1, wherein said tower is positionable on one side of an obstacle, said first anchor means is positionable on the opposite side of said obstacle, and said ski slope platform is suspendable over said obstacle.

6. The artificial ski slope of claim 1, wherein said ski slope platform is wedge shaped, being narrow in horizontal cross section at said tower and continuously expanding in horizontal cross section toward said first anchor means.

7. An artificial ski slope complex comprising: a tower; several first anchor means radially arrayed on one side and away from said tower substantially the length of a ski slope; several catenary suspension means secured between the top of said tower and said several anchor means; and several ski slope platforms suspended from said several catenary suspension means.

8. The artificial ski slope complex of claim 7, including several pluralities of ski slope platform suspension cables secured to and spaced along said several catenary suspension means to depend therefrom; said several pluralities of ski slope platform suspension cables being of predetermined variable lengths to define predetermined contours of said several ski platforms; and means to secure said several ski slope platforms to the dependent ends of said several variable length suspension cables.

9. The artificial ski slope complex of claim 7, including several second anchor means positioned on the opposite side of said tower, and means to secure said tower to said several second anchor means.

10. The artificial ski slope complex of claim 9, wherein said several ski slopes subject said tower to several first turning moments and aid several second anchor means and said means to secure said tower to said several second anchor means subject said tower to several second turning moments, equal and opposite to said several first turning moments.

11. The artificial ski slope complex of claim 7, wherein said tower is positionable on one side of an obstacle, said several first anchor means are positionable on the opposite side of said obstacle, and said several ski slope platforms are suspendable over said obstacle.

12. An artificial ski slope complex comprising: a tower; several anchor means arrayed circumferentially about said tower and radially away from said tower substantially the length of said ski slope; several catenary suspension means secured between the top of said tower and said several anchor means, respectively; and several ski slope platforms suspended from said several catenary suspension means.

13. The artificial ski slope complex of claim 12, including several pluralities of ski slope platform suspension cables secured to and spaced along said several catenary suspension means to depend therefrom; said several pluralities of ski slope platform suspension cables being of predetermined variable lengths to define predetermined contours of said several ski platforms; and means to secure said several ski slope platforms to the dependent ends of said several variable length suspension cables.

14. The artificial ski slope complex of claim 12, wherein for each of said several ski slope platforms there is a balancing ski slope platform, said balancing ski slope platform being arrayed radially opposite to said first-mentioned ski slope platform, whereby radially opposite ski slopes provide offsetting moments to produce sum-zero conditions of turning moments against said tower.

15. The artificial ski slope complex of claim 12, wherein said tower is positionable clear of obstacles; said anchor means are positionable clear of said obstacles; and said several ski slope platforms are suspendable over said obstacles.

16. The artificial ski slope of claim 1, including means to transversely stabilize said tower and means to transversely stabilize said ski slope platform.

17. The artificial ski slope of claim 1, including means to enclose said ski slope platform adapted to shield skiers from inclement weather.

18. The artificial ski slope of claim 1, including second anchor means positioned on said one side and away from said tower substantially the length of a second ski slope; second catenary suspension means secured at one end to said tower and at the other end to said second anchor means; and a second ski slope platform suspended from said second catenary suspension means.

19. The artificial ski slope of claim 15, including third anchor means positioned on said one side of said tower substantially the length of a third ski slope; third catenary suspension means secured at one end to said tower and at the other end to said third anchor means; and a third ski slope platform suspended from said third catenary suspension means.

20. The artificial ski slope of claim 1, including a plurality of anchor means positioned circumferentially about said tower; a corresponding plurality of catenary suspension means secured between said tower and said plurality of anchor means; and a corresponding plurality of ski slope platforms suspended from said plurality of catenary suspension means.

21. The artificial ski slope of claim 19, wherein said first, second, and third catenary suspension means are secured to said tower at different elevations.

22. The artificial ski slope of claim 20, wherein each of said plurality of catenary suspension means is secured to said tower at a predetermined elevation.

23. The artificial ski slope of claim 1, wherein said means to suspend said ski slope platform from said catenary suspension means are adjustable to selectively vary the inclination of said ski slope platform.

24. The artificial ski slope of claim 19, including corresponding adjustable first, second, and third means to suspend said ski slope platforms to selectively vary the inclination of said first, second, and third ski slope platforms.

25. The artificial ski slope of claim 20, including a corresponding plurality of adjustable means to suspend said plurality of ski slope platforms to selectively vary the inclinations of said plurality of ski slope platforms.

26. The artificial ski slope of claim 1, wherein said means to suspend said ski slope platform is selectively variable to provide several slope inclinations between said tower and said first anchor means.

* * * * *

UNITED STATES PATENT AND TRADEMARK OFFICE

CERTIFICATE OF CORRECTION

PATENT NO. : 4,976,422

DATED : Dec. 11, 1990

INVENTOR(S) : Shimamura

It is certified that error appears in the above—identified patent and that said Letters Patent is hereby corrected as shown below:

Column 4, Claim 10, line 19, change "aid" to --said--.

Column 5, Claim 19, line 5, change "15" to --18--.

Signed and Sealed this

Nineteenth Day of May, 1992

*Attest:*

DOUGLAS B. COMER

*Attesting Officer*

*Acting Commissioner of Patents and Trademarks*